United States Patent [19]

Sutherland

[11] Patent Number: 5,068,656

[45] Date of Patent: Nov. 26, 1991

[54] SYSTEM AND METHOD FOR MONITORING AND REPORTING OUT-OF-ROUTE MILEAGE FOR LONG HAUL TRUCKS

[75] Inventor: Dennis W. Sutherland, Marion, Iowa

[73] Assignee: Rockwell International Corporation, El Segundo, Calif.

[21] Appl. No.: 633,639

[22] Filed: Dec. 21, 1990

[51] Int. Cl.[5] ..... G08G 1/123

[52] U.S. Cl. ..... 340/989; 340/991; 340/993; 342/457

[58] Field of Search ..... 340/989, 431, 425.5, 340/434, 901, 904, 902, 988, 990, 991, 993, 438, 439; 342/457; 364/424.01, 424.02, 424.04, 449

[56] References Cited

U.S. PATENT DOCUMENTS

| | | | |
|---|---|---|---|
| 4,644,368 | 2/1987 | Mutz | 340/439 |
| 4,774,672 | 9/1988 | Tsunoda et al. | 340/988 |
| 4,804,937 | 2/1989 | Barbiaux et al. | 340/425.5 |
| 4,819,174 | 4/1989 | Furuno et al. | 340/995 |
| 5,014,206 | 5/1991 | Scribner et al. | 342/457 |

*Primary Examiner*—Jin F. Ng
*Assistant Examiner*—Brent A. Swarthout
*Attorney, Agent, or Firm*—Gregory G. Williams; M. Lee Murrah; H. Fredrick Hamann

[57] ABSTRACT

A system and method for monitoring and reporting out-of-route mileage for long haul trucks which includes transmitting route data from a dispatcher to a distant truck where comparisons aboard the truck are made of its current position with predetermined acceptable positions and exception reports are generated and transmitted back to the dispatcher from the truck if the current position is not included in the set of predetermined acceptable positions.

3 Claims, 5 Drawing Sheets

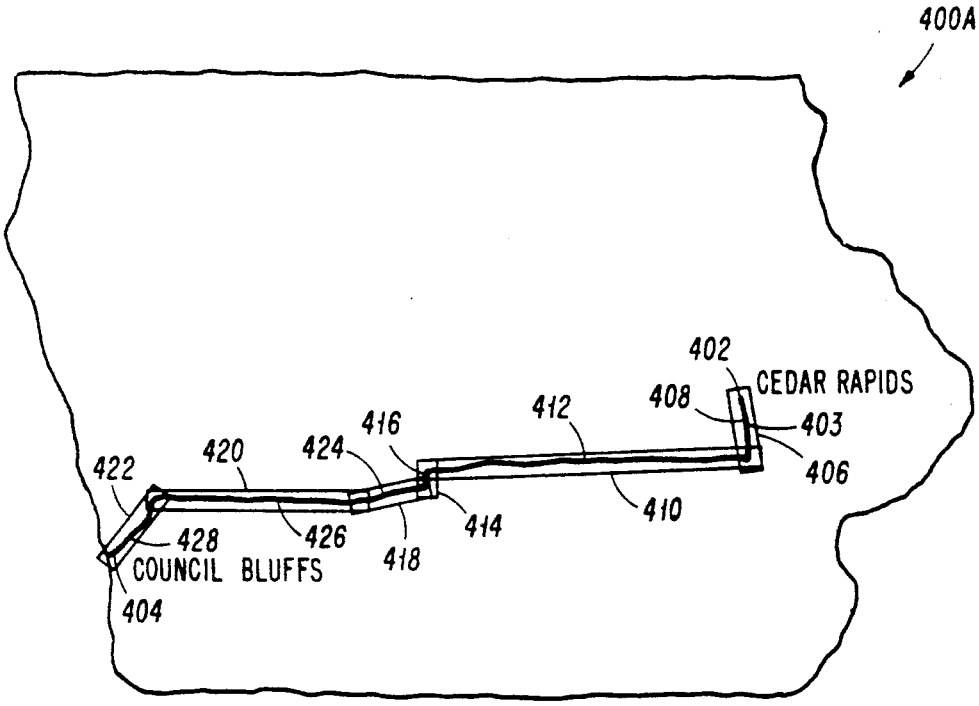
FIG. 4A
FIG. 4B
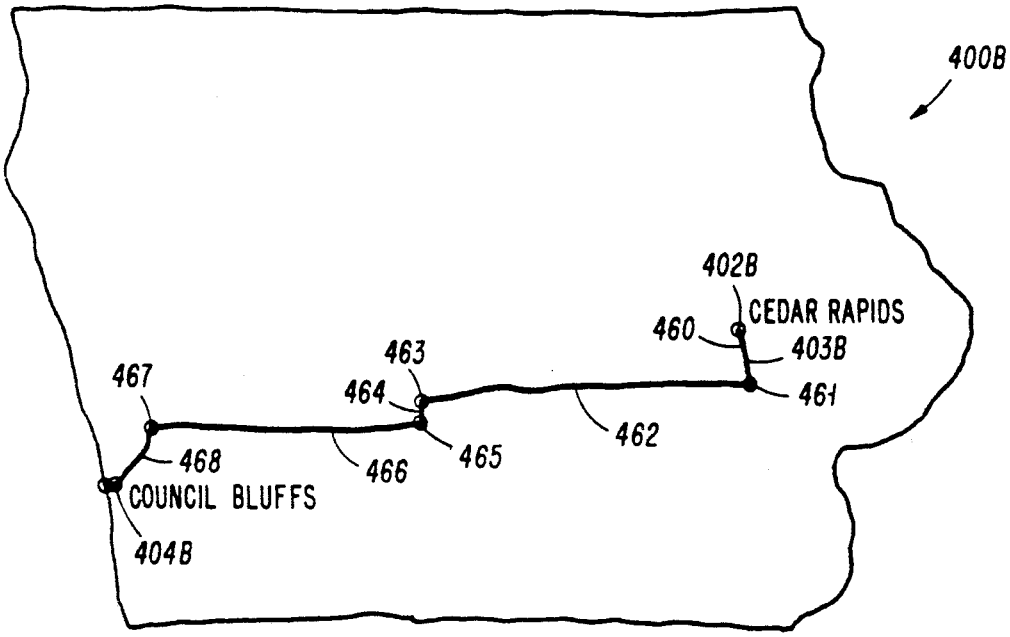

SYSTEM AND METHOD FOR MONITORING AND REPORTING OUT-OF-ROUTE MILEAGE FOR LONG HAUL TRUCKS

FIELD OF THE INVENTION

The present invention generally relates to satellite communications systems and more particularly relates to satellite communications systems for the long haul trucking industry and even more particularly relates to an apparatus and method for determining and reporting, to a central location, whether a particular truck at some distant location, is traveling outside of a predetermined acceptable route.

BACKGROUND OF THE INVENTION

For years trucking companies have attempted to monitor and control out-of-route mileage driven by long haul truckers. In the past, truck drivers have been known to, either unintentionally or intentionally, drive considerable distances from their assigned routes. These "out-of-route" miles are extremely expensive to trucking companies because of the additional fuel expense and maintenance expenses associated with the additional mileage.

Several different methods have been used in the past as attempts to restrict out-of-route mileage. One example is to require the truck driver to periodically stop the vehicle and telephone in the vehicle location. Another has been to monitor the actual mileage that has been driven and compare it to the predetermined route distance. Yet another is to continuously transmit, by radio etc., the truck's present position to a central dispatcher where it can be monitored.

While these methods have enjoyed some use in the past, they do have several serious drawbacks. First of all, the method which requires the truck driver to stop the vehicle and telephone in has disadvantages because it requires additional duties for the truck driver and associated delays. Furthermore, problems with the veracity and accuracy of the driver's position report can be frequent impediments to accurate and timely out-of-route determinations. The method of comparing the actual total mileage the truck was driven with the total predetermined route distance is undesirable because it cannot be performed in a real time fashion and must involve a lag time when the truck is being driven and when the comparisons are made. The method involving continuous radio transmission of the truck's current position to a central dispatcher is undesirable because it consumes much precious radio transmission time and further places a great burden on the central dispatcher and dispatcher's computer, especially if numerous trucks are being simultaneously monitored.

Consequently there exists a need for improvement in the monitoring and reporting of out-of-route mileage for the trucking industry.

SUMMARY OF THE INVENTION

It is an object of the present invention to provide an apparatus and method for reducing the out-of-route distances travelled by trucks.

It is a feature of the present invention to include a satellite communications system and on-board truck position determining system.

It is an advantage of the present invention to determine information concerning truck position in a real-time fashion.

It is another feature of the present invention to provide an on-board apparatus for determining whether the current truck position is outside of a predetermined acceptable route and generating an exception report if appropriate.

It is another advantage of the present invention to alert the central dispatcher of any out-of-route trucks without the need for continuous transmission of vehicle position to the central dispatcher.

The present invention provides a satellite communication and truck position system with the capability of monitoring and reporting out-of-route truck mileage which is designed to satisfy the aforementioned needs, produce the earlier propounded objects, include the above described features and achieve the already articulated advantages. The invention is carried out in a "driver-less" system in a sense that the need for actual involvement of the truck driver in the out-of-route mileage determination is eliminated. Instead, the current truck position and acceptable truck position comparisons are made by an on-board apparatus which requires no driver interaction. Additionally, the invention is carried out in a "lag time-less" system in a sense that the lag time that is generally associated with comparing the actual driven mileage with the acceptable route mileage, after the trip has ended, is eliminated. Instead, the determination of the out-of-route mileage is made on a real time or near real time basis.

Furthermore, the invention is carried out in an "excessive computer burden-less" system in the sense that the excessive computer burden associated with receiving, monitoring, and processing continuous position reports from numerous vehicles is eliminated. Instead, the determination of out-of-route mileage is done on-board the truck and an exception report is issued only when the vehicle is outside the assigned route, thereby greatly reducing the radio transmission and central computer burden when the trucks are within the route.

Accordingly, the present invention provides a system and method for monitoring and reporting out-of-route mileage for long haul trucks, including means for determining geographic position of a truck, means for transmitting and receiving information between the truck and a dispatch station, means on-board said truck for comparing said geographic position of said truck with a range of acceptable predetermined geographic positions for said truck and means for generating an exception report when said geographic position is outside of the range of acceptable predetermined geographic positions.

BRIEF DESCRIPTION OF THE DRAWINGS

The invention may be more fully understood by reading the following description of a preferred embodiment of the invention in conjunction with the appended drawings wherein:

FIG. 4A is a geographic representation of a representative truck route containing predetermined acceptable route rectangles of FIG. 3A.

FIG. 4B is a geographic representation of a representative truck route containing zones separated by routes of predetermined length of FIG. 3B.

DETAILED DESCRIPTION

Figure 1:
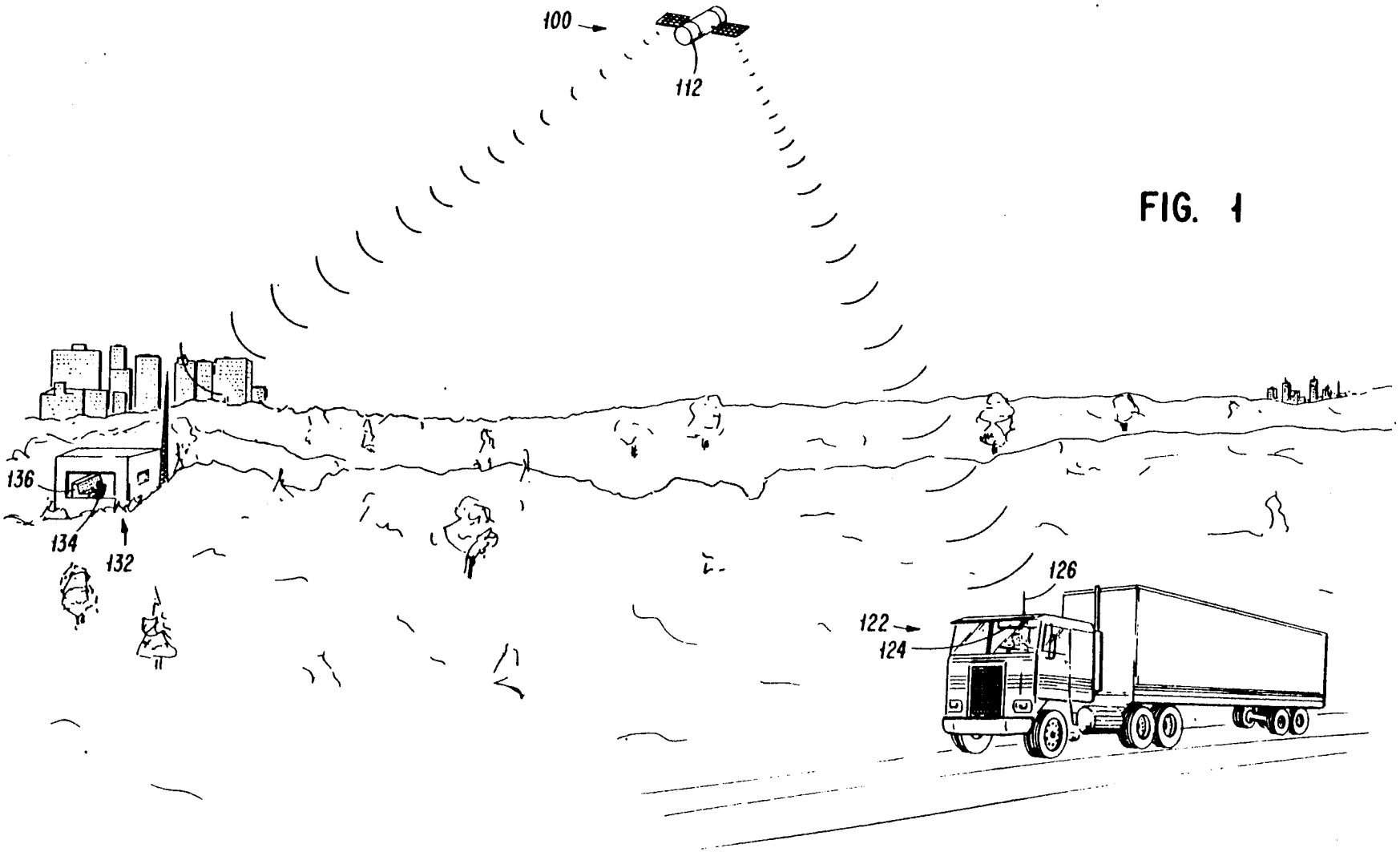
FIG. 1 is a representation of the system of the present invention including the mobile unit which generates position exception reports, the satellite and the dispatch station which accepts and processes position exception reports.

Now referring to FIG. 1, there is shown a system for monitoring and reporting out-of-route mileage, of the present invention, generally designated 100. System 100 includes a communications satellite 112, a tractor-trailer combination 122 and a dispatch center 132.

Tractor-trailer 122 includes a mobile transceiver unit 124 disposed on board for generating and transmitting position exception report signals through antenna 126 to the dispatcher 134 at dispatch terminal 136 by way of antenna/transceiver at dispatch center 132. This description is merely exemplary of many possible tractor/-satellite/dispatch center combinations. It is also contemplated that a single earth station could receive signals from the satellite and rely the messages via telephone lines to various geographically dispersed dispatchers. Also, other transmitter and receiver combinations may be utilized which do not use satellite communications. For example, traditional radio communications or radio/telephone communications could be substituted for the satellite communications system.

Figure 2:
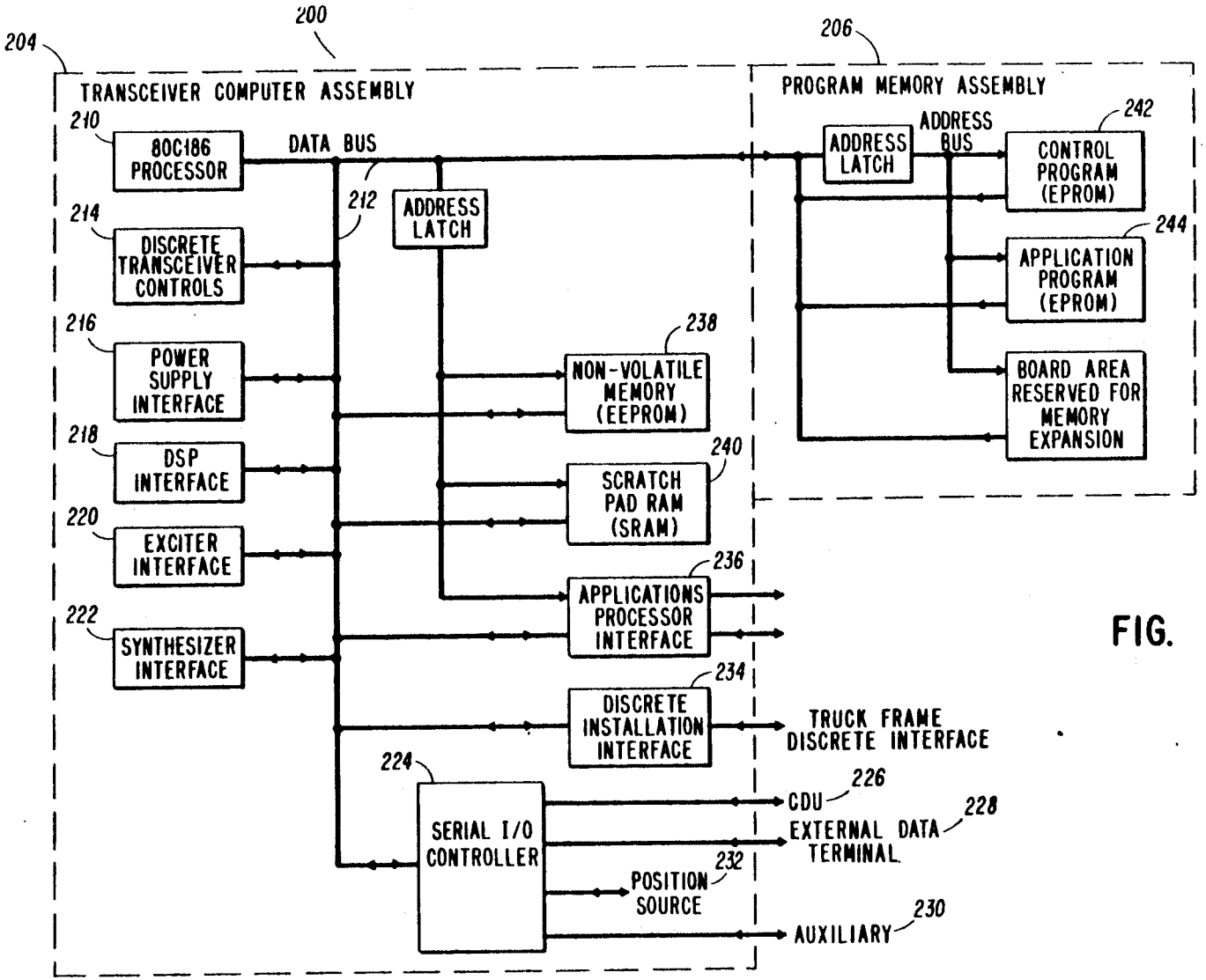
FIG. 2 is a functional block diagram representation of the apparatus of the present invention which is located on board the truck.

Now referring to FIG. 2, there is shown a block diagram of the apparatus of the present invention, generally designated 200, including a transceiver computer assembly 204 and a program memory assembly 206.

The apparatus 200 is shown as an example, but other designs which are capable of performing the same functions of radio communication and comparison of current position with predetermined acceptable positions may be substituted.

Transceiver computer assembly 204 includes processor 210, which is preferably an 80C186 processor, which is capable of performing many functions including route rectangle generation and the comparison of current position with predetermined acceptable positions. Processor 210 is coupled with data bus 212. Also coupled with data bus 212 is discrete transceiver controls 214 which provides the normal control functions for a transceiver assembly, power supply interface 216 which provides the power source necessary for a typical transceiver assembly, a Digital Signal Processor (DSP) interface 218 for extracting the digital information stream from an extremely low signal to noise ratio radio frequency transmission and is preferably a ADSP2105, and exciter interface 220 for controlling the transmitter output signal to noise ratio, a synthesizer interface 222 for controlling the transmitter and receiver frequency at low phase noise correcting for Doppler shift over a wide temperature range, with high frequency stability which is preferably an ASIC circuit and a serial I/0 controller 224 which is preferably a Z85C30 and is used to control the input and output of data from a variety of sources including a CDU 226, an external data terminal 228, an auxiliary data source 230 and a position source 232, CDU 226 may be a device providing for alphanumeric keyboard, special function keys for control, display area for text messages, status lights, and audible annunciator to alert vehicle driver, external data terminal 228 may be a keyboard or other device for allowing the driver to manually in put data, the auxiliary data source may be an additional data source of any type but, preferably is a Rockwell International "Tripmaster" data recorder, or similar data recorder and the position source 232 may be a GPS receiver or a Loran C receiver or any other device which is capable of providing a report on the vehicle position.

Also coupled to data bus 212 are the discrete installation interface 234 and the applications processor interface 236. Also coupled to data bus 212 and applications processor 236 are memories including nonvolatile memory 238 and scratch pad RAM 240.

Transceiver computer assembly 204 is coupled to program memory assembly 206 through data bus 212 which provides access to control program EPROM 242 and applications program EPROM 244.

Figure 3A:
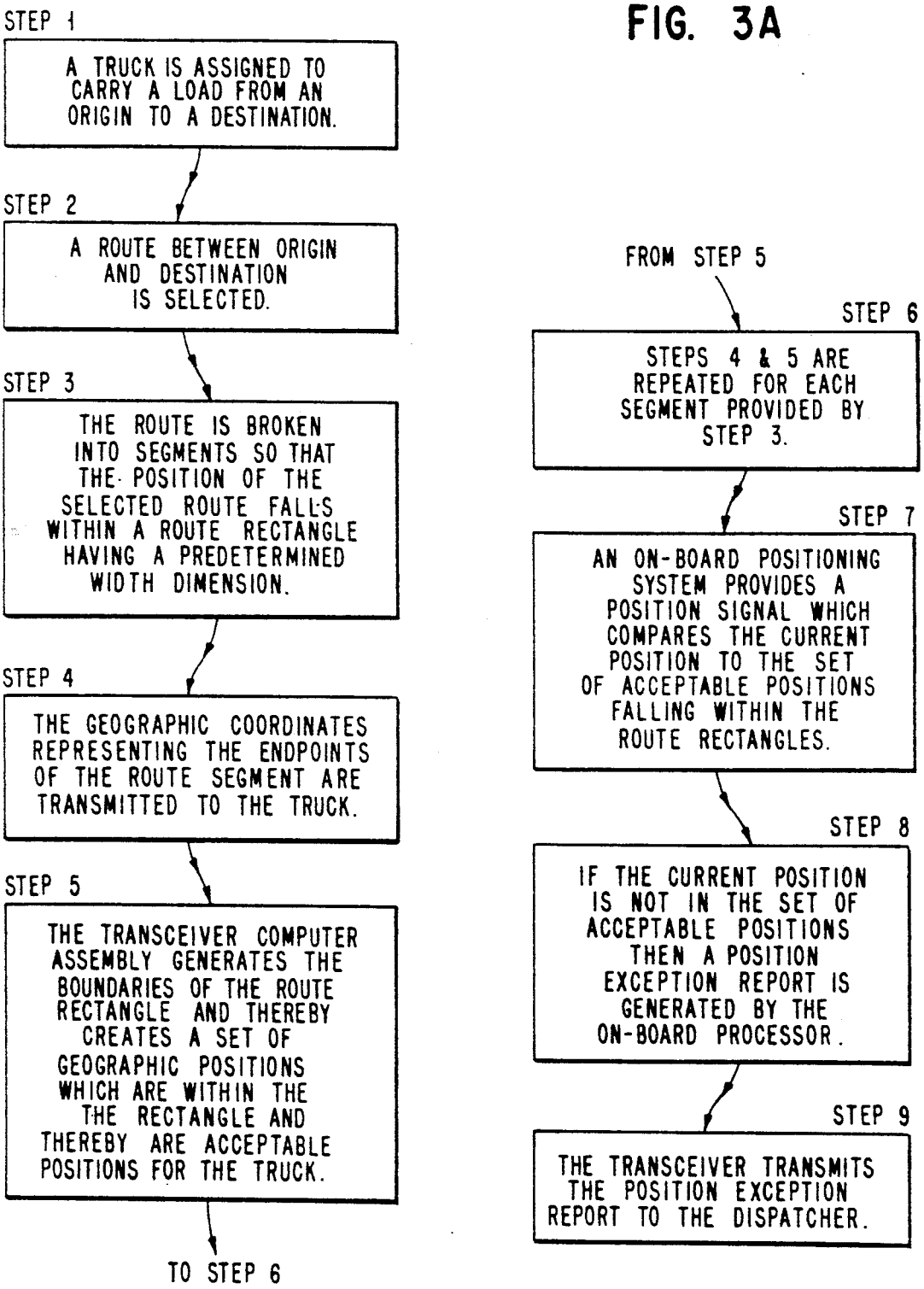
FIGS. 3A & 3B are flow charts of the method of the present invention for determining and reporting out-of-route mileage.

Now referring to FIG. 3A, there is shown a flow chart of a preferred method of the present invention including:

Step 1. A truck is assigned to carry a load from an origin to a destination.

Step 2. A route between origin and destination is selected.

Step 3. The route is broken into segments, so that, the position of the selected route falls within a route rectangle having a predetermined width dimension and variable length dimension.

Step 4. The geographic coordinates representing the endpoints of the route segment are transmitted to the truck.

Step 5. The on-board processor generates the boundaries of the route rectangle so that the opposite ends of the rectangle are a predetermined distance from the route segment end points and thereby creates a set of geographic positions which are located within the rectangle and thereby are acceptable positions for the truck.

Step 6. Steps 4 and 5 are repeated for each segment provided by Step 3.

Step 7. An on-board positioning system provides a current position signal, then the on-board processor compares the current position signal to the set of acceptable positions falling within the route rectangles.

Step 8. If the current position is not in the set of acceptable positions, then a position exception report is generated by the on-board processor.

Step 9. The transceiver transmits the position exception report to the dispatcher.

Figure 3B:
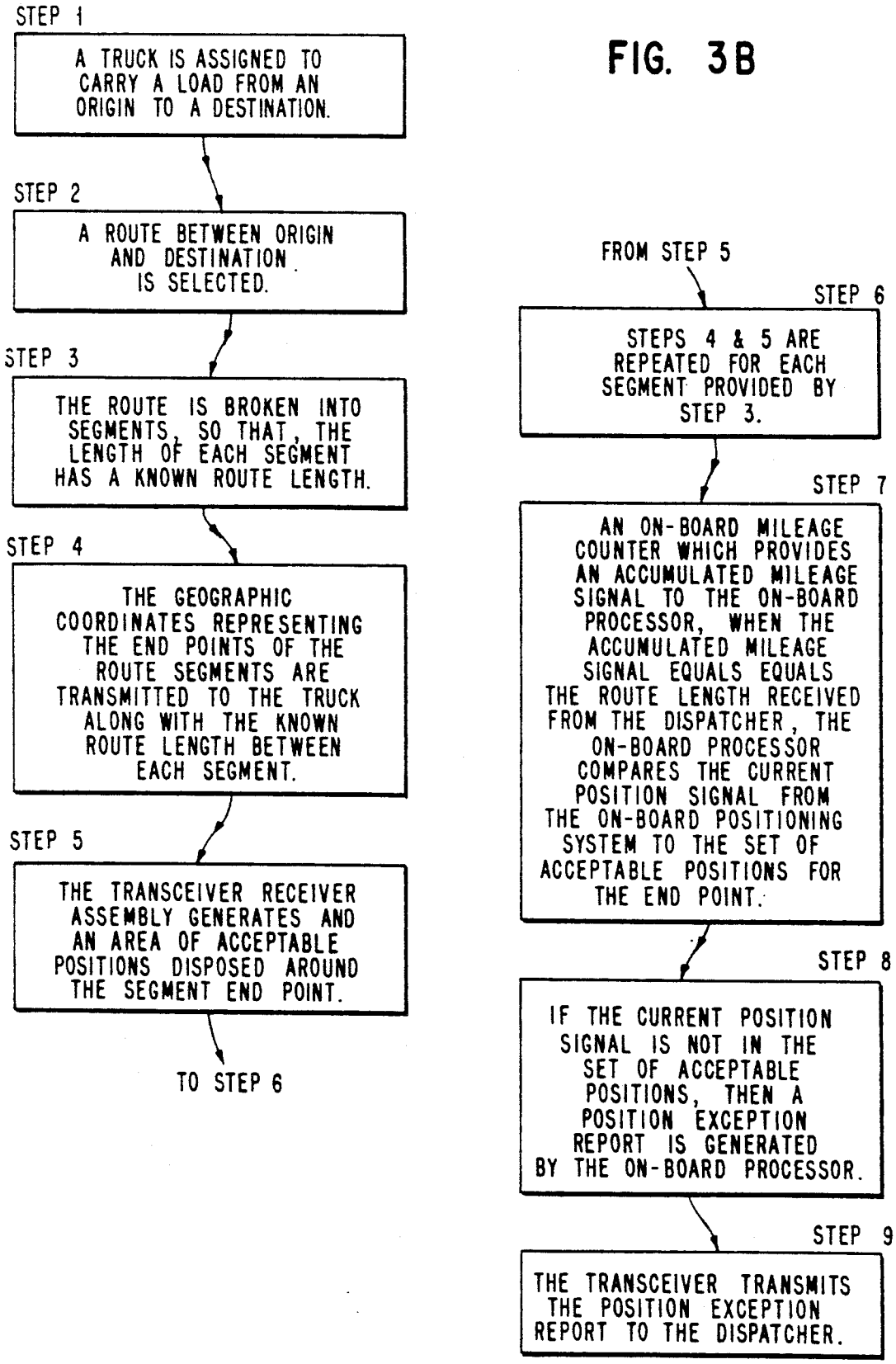

Now referring to FIG. 3B there is shown a flow chart of the method of the present invention including:

Step 1. A truck is assigned to carry a load from an origin to a destination.

Step 2. A route between origin and destination is selected.

Step 3. The route is broken into segments, so that, the length of each segment has a known route length.

Step 4. The geographic coordinates representing the end points of the route segments are transmitted to the truck along with the known route length for each segment.

Step 5. The transceiver receiver assembly generates and an area of acceptable positions disposed around the segment end point.

Step 6. Steps 4 and 5 are repeated for each segment provided by Step 3.

Step 7. An on-board mileage counter which provides an accumulated mileage signal to the on-board processor. When the accumulated mileage signal equals the route length received from the dispatcher, the on-board processor compares the current position signal from the on-board positioning system to the set of acceptable positions for the end point.

Step 8. If the current position signal is not in the set of acceptable positions, then a position exception report is generated by the on-board processor.

Step 9. The transceiver transmits the position exception report to the dispatcher.

Now referring to FIG. 4A, there is shown a geographic map, of a portion of the state of Iowa, generally designated 400A, which includes a references point 402, corresponding to the city of Cedar Rapids, Iowa and a reference point 404 corresponding to the city of Council Bluffs, Iowa. Extending between points 402 and 404 is solid line 403 which represents a selected route from the origin at Cedar Rapids to the destination at Council Bluffs.

Also shown is a first route rectangle 406 which extends generally southward from a point north of Cedar Rapids. Enclosed in rectangle 406 is line segment 408 which represents a route segment corresponding to a section of Interstate 380. Also shown is route rectangle 410 having therein line 412 representing a route segment corresponding to a section of Interstate 80. Also shown is a route rectangle 414 having line 416 therein which represents another section of Interstate 80. Also shown are route rectangles 418, 420, and 422 containing therein lines 424, 426 and 428 respectively which each represent a section of Interstate 80.

It can be seen that the lines 408, 412, 424, 426, and 428 are generally linear and are always located completely within their respective route rectangles. In fact, the orientation and dimension of the route rectangles are selected so that the route segment contained therein is at a maximum length and thereby creating the need for a minimum number of route rectangles on any particular route.

In operation, as a truck proceeds from Cedar Rapids, the origin, to Council Bluffs, the destination, the on-board positioning system and on-board processor are frequently determining the current position of the truck and comparing it to the set of acceptable positions falling within the route rectangles. If the driver either intentionally or unintentionally deviates from the assigned route, to the extent that the truck is no longer located in the route rectangle, the on-board processor will generate an exception report and it will be transmitted to the dispatcher, where appropriate actions can be taken. If the truck operates entirely on the assigned route and never leaves the route rectangles, then no exception reports will be generated.

Now referring to FIG. 4B, there is shown a geographic map of, a portion of the state of Iowa, generally designated 400B, which includes a reference point 402B corresponding to Cedar Rapids, Iowa and a reference point 404B corresponding to Council Bluffs, Iowa, the destination. Extending between points 402B and 404B is line 403B which corresponds to the selected route between origin Cedar Rapids and destination Council Bluffs. Line 403B is broken into a series of line segments 460, 462, 464, 466 and 468. The line segments join at junction points 461, 463, 465 and 467. Disposed around each of the junction points is shown a circular zone which corresponds to a predetermined zone about the junction point in which a set of acceptable positions are located.

In operation, once the route has been determined to extend from Cedar Rapids to Council Bluffs the particular route path is selected and is broken into several segments where each segment has a known route length. When the vehicle is progressing along the route, the on-board mileage counter or "Tripmaster" ® accumulates the mileage travelled from the last junction point and provides a signal to the processor. When this accumulated mileage signal equals the known route length, which has been transmitted from the dispatch center to the on-board processor, the processor then compares the current position information from the on-board positioning system with the set of acceptable positions located in the circle about the next junction point. If the vehicle has travelled on the assigned route, then the vehicle will be located within the circle of acceptable positions and no exception report will be generated. However, if the vehicle has significantly departed from the assigned route and is not located in the circle of acceptable positions after driving the preassigned route length, then an exception report will be generated and transmitted back to the dispatcher where appropriate action can take place. If no exception report is generated as the vehicle passes a junction point, then the mileage counter is reset to zero and the process continues again until the mileage counter has accumulated mileage equivalent to the known route mileage for the new segment. At that time the present vehicle position will be again compared to the positions located at the new circle surrounding the new junction point.

The above description focuses on determination of out-of-route-mileage by dividing the preassigned route into manageable route segments of known length, however it may also be desirable to transmit to the vehicle intermediate points such as state line crossings, toll road entrances, toll road exits, cargo pickup points, cargo drop off points, etc. These points could be used as endpoints of line segments or as intermediate points. As intermediate points they would not necessarily be at a known distance from a previous point but would serve to provide valuable information by comparing the current position signal with a set of predetermined acceptable position signals disposed about each of these intermediate points. If a current position signal matches with an acceptable position in the circle of acceptable positions for the first expected intermediate point, then thereafter, the current position signal will be compared with the set of acceptable positions corresponding to the next intermediate point and so on throughout the series of intermediate points.

The system for monitoring and reporting out-of-route mileage for long haul trucks, of the present invention, in many of its attendant advantages will be understood from the foregoing description and it will be apparent that various changes may be made in the form, construction, and the arrangement of the parts, without departing from the spirit and scope of the invention, or sacrificing all of their material advantages, the form herein being merely a preferred or exemplary embodiment thereof.

I claim:

1. A system for monitoring and reporting out-of-route mileage trucks comprising:

means for transmitting signals corresponding to geographic coordinates from a central dispatch station to a truck at some distant point;

means for receiving the signals corresponding to the geographic coordinates from the central dispatch;

means for generating route rectangles indicative of areas surrounding road segments to be travelled on board a truck and without driver action having the geographic coordinates at either a first end of a second end of a route rectangle;

means for providing a position signal corresponding to the current position of the truck;

means for comparing the position signal on board a truck and without driver action with a set of predetermined acceptable positions within a route rectangle;

means for generating an exception report without driver intervention if the position signal is not included in the set of acceptable positions;

means for transmitting the exception report to the central dispatcher; and means for receiving an exception report on a real-time basis and alerting a central dispatcher of an out-of-route status in a timely manner.

2. A method of monitoring and reporting out-of-route mileage trucks comprising the steps of:

determining, at a first location, a specific route for a predetermined origin and destination;

transmitting signals corresponding to the origin and the destination from the first location to a vehicle at a second location;

generating route rectangles indicative of areas surrounding road segments to be travelled on board the vehicle based on the signals from the first location, wherein the rectangles define a plurality of acceptable positions;

providing a position signal corresponding to the current position of the vehicle;

comparing the position signal with the plurality of acceptable positions;

generating an exception report if the position signal is not included in the plurality of acceptable positions; and, transmitting the exception report from the vehicle at the second location to the first location.

3. A method of monitoring and reporting out-of-route mileage trucks comprising the steps of:

determining at a first location a specific route for a predetermined origin and destination;

dividing the route into a series of one or more route segments each having a predetermined route length;

transmitting signals to a vehicle from the first location corresponding to the geographic coordinates representing the endpoints of each of the route segments together with the predetermined length for each route segment;

generating on board a vehicle an area of acceptable positions disposed around the endpoints;

providing an accumulated mileage signal corresponding to the accumulated mileage the vehicle has traversed;

providing a current position signal corresponding to the position of the vehicle;

comparing the current position signal with the area of acceptable positions after the accumulated mileage signal has reached the predetermined route length for the route segment; and, transmitting an exception report from the vehicle to the first location if the current position signal is not in the area of acceptable positions.

* * * * *